US005513545A

United States Patent [19]

George

[11] Patent Number: 5,513,545

[45] Date of Patent: May 7, 1996

[54] HEAD BOLT STUD AND EXTRACTOR TOOL

[76] Inventor: Mark George, 9008 Beverly Hill, Houston, Tex. 77063

[21] Appl. No.: 189,795

[22] Filed: Feb. 1, 1994

[51] Int. Cl.[6] ..... B25B 13/50

[52] U.S. Cl. ..... 81/53.2; 81/459; 81/177.1

[58] Field of Search ..... 81/120, 121.1, 81/177.4, 459, 124.7, 490, 53.2, 177.1, 177.5; 411/388, 389, 244, 245

[56] References Cited

U.S. PATENT DOCUMENTS

| | | | |
|---|---|---|---|
| 1,209,658 | 12/1916 | Baltzley | 81/124.7 |
| 1,453,913 | 5/1923 | Burdick . | |
| 1,921,379 | 8/1933 | Bailey | 29/84 |
| 2,336,164 | 12/1943 | Chaskin | 411/244 |
| 2,576,003 | 11/1951 | Dry | 85/1 |
| 2,593,648 | 4/1952 | Aukersl | 29/285 |
| 2,775,153 | 12/1956 | Parhaniemi | 81/53.2 |
| 2,848,798 | 8/1958 | Davis | 29/271 |
| 2,854,741 | 10/1958 | Cholger | 29/271 |
| 2,951,406 | 9/1960 | Brase | 81/53.2 |
| 3,624,884 | 12/1971 | Scime | 29/200 |
| 4,570,320 | 2/1986 | Kile | 29/271 |
| 4,702,131 | 10/1987 | Snow | 81/177.5 |
| 4,809,569 | 3/1989 | Erb | 81/121.1 |
| 5,123,812 | 6/1992 | Groenendaal, Jr. | 415/209.2 |
| 5,181,304 | 1/1993 | Piotrowski | 29/271 |

*Primary Examiner*—Bruce M. Kisliuk
*Assistant Examiner*—Joni B. Danganan
*Attorney, Agent, or Firm*—Browning, Bushman, Anderson & Brookhart

[57] ABSTRACT

A tool, comprising a head bolt stud and extractor, useful in the alignment of a cylinder head to an engine block when re-attaching the cylinder head to the engine block following replacement of the cylinder head seals.

12 Claims, 3 Drawing Sheets

HEAD BOLT STUD AND EXTRACTOR TOOL

SUMMARY OF THE INVENTION

A. Field of Invention

The present invention relates to the field of tools utilized to align a cylinder head to an engine block when re-attaching the cylinder head to the engine block following replacement of the cylinder head seals.

More particularly, the present invention relates to tools utilized to align a cylinder head to an engine block when re-attaching the cylinder head to the engine block following replacement of the cylinder head seals which comprise head bolt studs which are screwably inserted in the engine block and extend above the surface of the engine block to provide a guide for cylinder head placement upon the engine block.

Yet more particularly, the present invention relates to tools utilized to align a cylinder head to an engine block when re-attaching the cylinder head to the engine block following replacement of the cylinder head seals which comprise head bolt studs which are screwably inserted in the engine block and extend above the surface of the engine block to provide a guide for cylinder head placement upon the engine block and which further comprise a component useful for extraction of the head bolt studs from the engine block after the cylinder heads are in position.

Yet more particularly, the present invention relates to tools utilized to align a cylinder head to an engine block when re-attaching the cylinder head to the engine block following replacement of the cylinder head seals which comprise head bolt studs which are screwably inserted in the engine block and extend above the surface of the engine block to provide a guide for cylinder head placement upon the engine block and which further comprise a component useful, within the space limitations usually imposed by the placement of the engine within the vehicle chassis, for extraction of the head bolt studs from the engine block after the cylinder heads are in position.

B. Background of the Invention

One of the most difficult tasks in the rebuilding of internal combustion engines is the alignment of the cylinder head with the engine block for assembly of the cylinder head to the engine block after the cylinder head seals are replaced. Cylinder heads are heavy and difficult to maneuver into proper alignment above the engine block. In numerous applications the location of the engine block within the vehicle chassis is such that the available space for maneuvering is extremely limited.

After the work has been completed on the engine block and the head or heads, a cylinder head gasket, or in the case of diesel engines, several individual gaskets, are placed in various locations on the engine block. The cylinder head is then positioned above the engine block and the cylinder head bolts are inserted through the bolt holes in the cylinder head into the corresponding threaded holes in the engine block. Diesel engines, which have much higher compression ratios than gasoline engines and often utilize individual gaskets around each of the cylinder holes, compound the problem should one or more of the cylinder head gaskets become misaligned during positioning of the cylinder head onto the engine block. Misalignment of the cylinder head gasket(s) due to misalignment of the cylinder head during placement onto the engine block may result in compression loss and is usually not apparent until the engine has been completely assembled and test run. Correction of the cylinder head gasket misalignment problem requires tear down and reassembly of the cylinder heads onto the engine block.

Various solutions to the problem of positioning the cylinder head squarely upon the engine block without causing misalignment of the cylinder head gasket(s) have been attempted. Inserting threaded rods into the engine block bolt holes and positioning the cylinder heads on them is known. But no satisfactory solution has been proposed whereby the removal of the threaded rods from the engine block is easily accomplished within the space limitations usually encountered when replacing the cylinder head upon the engine block.

Accordingly, a substantial need exists for a tool which may be utilized to align a cylinder head to an engine block when re-attaching the cylinder head to the engine block following replacement of the cylinder head seals.

An additional need exists for a tool which may be utilized to align a cylinder head to an engine block when re-attaching the cylinder head to the engine block following replacement of the cylinder head seals which comprises a head bolt stud which may be screwably inserted in the engine block and which extends above the surface of the engine block to provide a guide for cylinder head placement upon the engine block.

A further need exists for a tool which may be utilized to align a cylinder head to an engine block when re-attaching the cylinder head to the engine block following replacement of the cylinder head seals which comprises a head bolt stud which may be screwably inserted in the engine block and which extends above the surface of the engine block to provide a guide for cylinder head placement upon the engine block and which further comprises a component useful for extraction of the head bolt stud from the engine block after the cylinder head is in position.

A yet further need exists for a tool which may be utilized to align a cylinder head to an engine block when re-attaching the cylinder head to the engine block following replacement of the cylinder head seals which comprises a head bolt stud which may be screwably inserted in the engine block and which extends above the surface of the engine block to provide a guide for cylinder head placement upon the engine block and which further comprises a component useful, within the space limitations usually imposed by the placement of the engine within the vehicle chassis, for extraction of the head bolt stud from the engine block after the cylinder heads are in position.

Accordingly, it is a primary object of this invention to provide a tool which may be utilized to align a cylinder head to an engine block when re-attaching the cylinder head to the engine block following replacement of the cylinder head seals.

It is another object of this invention to provide a tool which may be utilized to align a cylinder head to an engine block when re-attaching the cylinder head to the engine block following replacement of the cylinder head seals which comprises a head bolt stud which may be screwably inserted in the engine block and which extends above the surface of the engine block to provide a guide for cylinder head placement upon the engine block.

It is yet another object of this invention to provide a tool which may be utilized to align a cylinder head to an engine block when re-attaching the cylinder head to the engine block following replacement of the cylinder head seals which comprises a head bolt stud which may be screwably inserted in the engine block and which extends above the surface of the engine block to provide a guide for cylinder head placement upon the engine block and which further comprises a component useful for extraction of the head bolt stud from the engine block after the cylinder head is in position.

It is a further and final object of this invention to provide a tool which may be utilized to align a cylinder head to an engine block when re-attaching the cylinder head to the engine block following replacement of the cylinder head seals which comprises a head bolt stud which may be screwably inserted in the engine block and which extends above the surface of the engine block to provide a guide for cylinder head placement upon the engine block and which further comprises a component useful, within the space limitations usually imposed by the placement of the engine within the vehicle chassis, for extraction of the head bolt stud from the engine block after the cylinder heads are in position.

Further features and advantages of the invention will become apparent from the following description when read with reference to the accompanying drawings.

DESCRIPTION OF THE PREFERRED EMBODIMENTS

Figure 1:
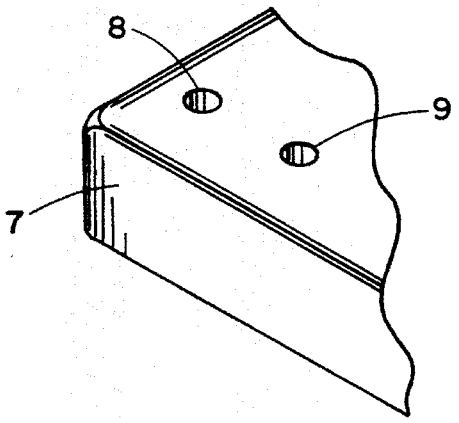
FIG. 1 is a partially cutway perspective view of an engine block with head bolt studs inserted together with a partially cutaway perspective view of an engine cylinder head wherein both partially cutaway views share the same perspective horizontal alignment.
Figure 1:
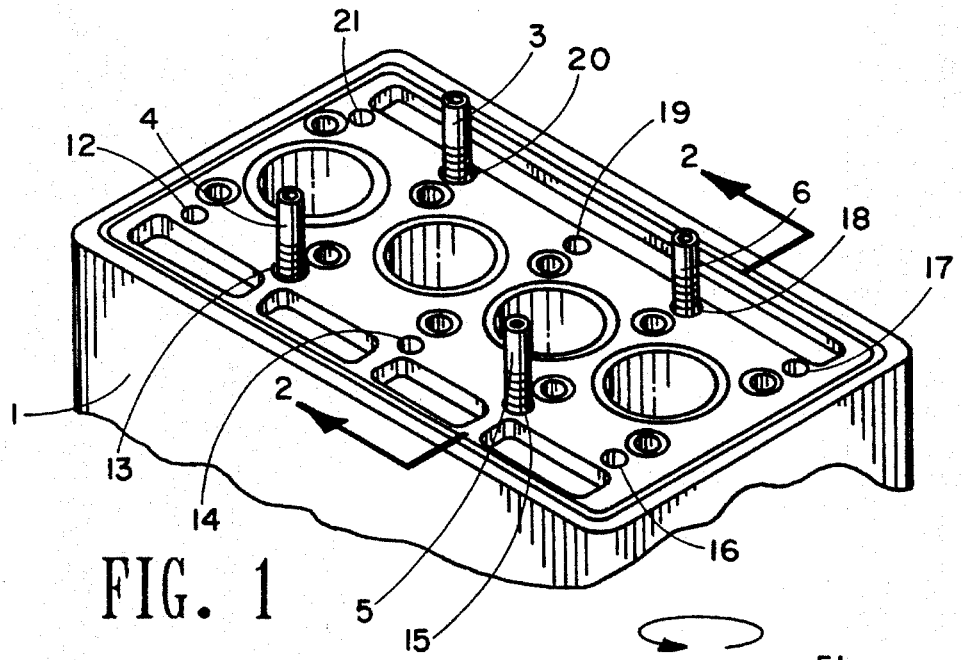
Figure 2:
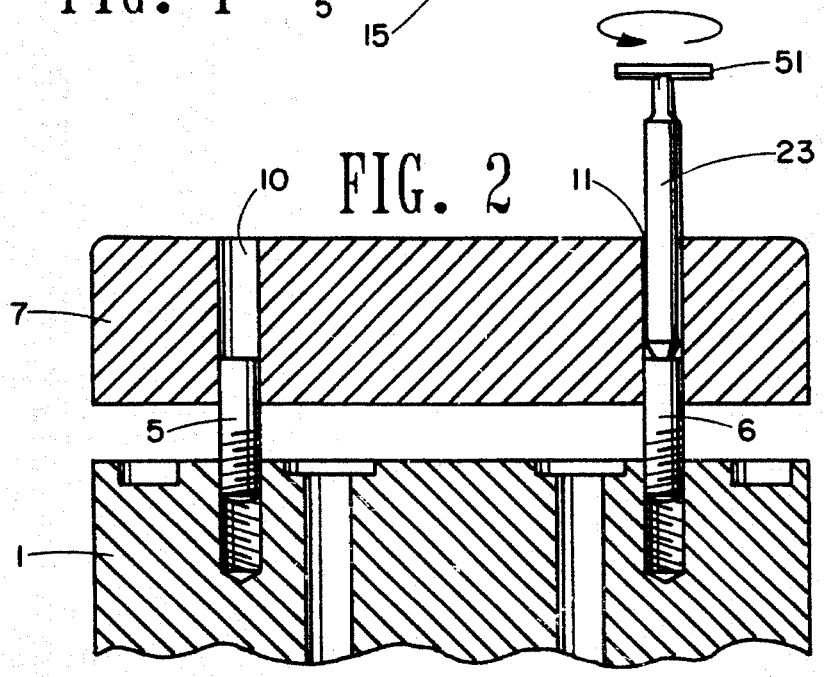
FIG. 2 is a partially cutaway lateral plane view taken across line 2—2 of FIG. 1 of an engine block and of an engine cylinder head in partial repose upon the engine block with head bolt studs inserted and with head bolt stud extractor in the process of removal of a head bolt stud.

Referring to FIG. 1, an engine block (1) is illustrated which has inserted therein four head bolt studs (3, 4, 5, and 6). Additionally illustrated in FIG. 1 is a portion of a cylinder head (7) containing bolt holes (8 and 9). As guide for placement of the cylinder head (7) onto the engine block (1) by virtue of the slideable insertion of the head bolt stud (4) through the bolt hole (9). Likewise, head bolt studs (3, 5, and 6) may serve as additional guides for placement of the cylinder head (7) onto the engine block (1) by virtue of the slideable insertion of the head bolt studs (3, 5, and 6) through bolt holes (10 and 11, and another bolt hole in the cylinder head (7) corresponding to head bolt stud (3), which bolt hole is not shown) in the cylinder head (7).

Figure 8:
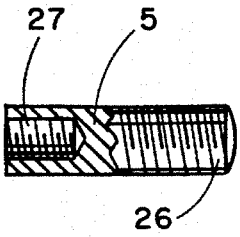
FIG. 8 is a head bolt stud having a right-hand threaded end for insertion into an engine block and a left-hand internally threaded extractor engagement end.
Figure 5:
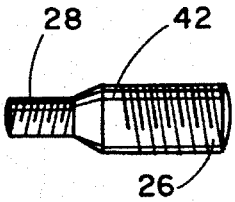
FIG. 5 is a head bolt stud having a right-hand threaded end for insertion into an engine block and a left-hand externally threaded extractor engagement end.

The engine block (1) provides threaded bolt holes (12, 13, 14, 15, 16, 17, 18, 19, 20, and 21) to receive cylinder head bolts (not shown) which are externally right-hand threaded at one end and typically provide a hexagonal bolt head at the other end. The head bolt studs (3, 4, 5, and 6) of the instant invention provide, in the first embodiment, external right-handed threads (26) on one end, and provide internal left-handed threads (27) on the other end, as seen in FIG. 8. The head bolt studs (3, 4, 5, and 6) of the instant invention provide, in the second embodiment, external right-handed threads (26) on one end, and provide external left-handed threads (28) on the other end, as seen on the head bolt stud (42) shown in FIG. 5. In both embodiments, that portion of each head bolt stud ( 3, 4, 5, or 6) which provides external right-handed threads (26) screwably inserts into one of the bolt holes (12, 13, 14, 15, 16, 17, 18, 19, 20, or 21) of the engine block (1).

In FIG. 1, the head bolt studs (3, 4, 5, and 6) are shown screwably inserted into four of the engine block (1) bolt holes (13, 15, 18, and 20 There may, in practice be any number of head bolt studs utilized. Four has been found to be a desirable number of head bolt studs due to the ability to slide the cylinder head (7) over the engine block (1) on the tops of the head bolt studs (3, 4, 5, and 6) into position so that the head bolt studs (3, 4, 5, and 6) align with the bolt holes (9, 10, 11 and one other bolt hole not shown) of the cylinder head (7). Six or more head bolt studs are desirable on some larger engines. Selection of which engine block (1) bolt holes (12, 13, 14, 15, 16, 17, 18, 19, 20, and 21) to insert the head bolt studs (3, 4, 5, and 6) into is made by the mechanic or user and should be selected to provide adequate spacing between the head bolt studs (3, 4, 5, and 6) for stability of the cylinder head (7) while it is being guided into position onto the top of the engine block (1). Use of the corner bolt holes (12, 16, 17, and 21) is often found to be better than use of the interior bolt holes (13, 14, 15, 18, 19, and 20) as tipping of the cylinder head (7) may occur while sliding the cylinder head (7) into position onto the top of the engine block (1) which tipping may cause damage to or misalignment of the gasket which is normally in place between the engine block (1) and the cylinder head (7).

Figure 3:
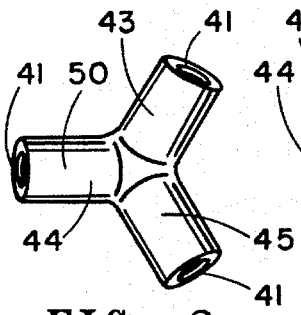
FIG. 3 is a top view of the head bolt stud extractor in FIG. 4.
Figure 4:
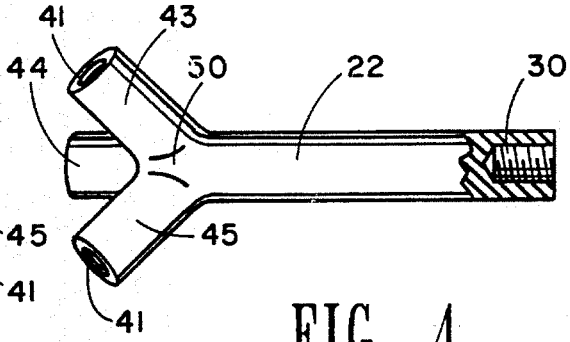
FIG. 4 is a partially cutaway lateral view of a head bolt stud extractor having an inverted tripod shaped handle and an internally threaded head bolt stud engagement end.
Figure 15:
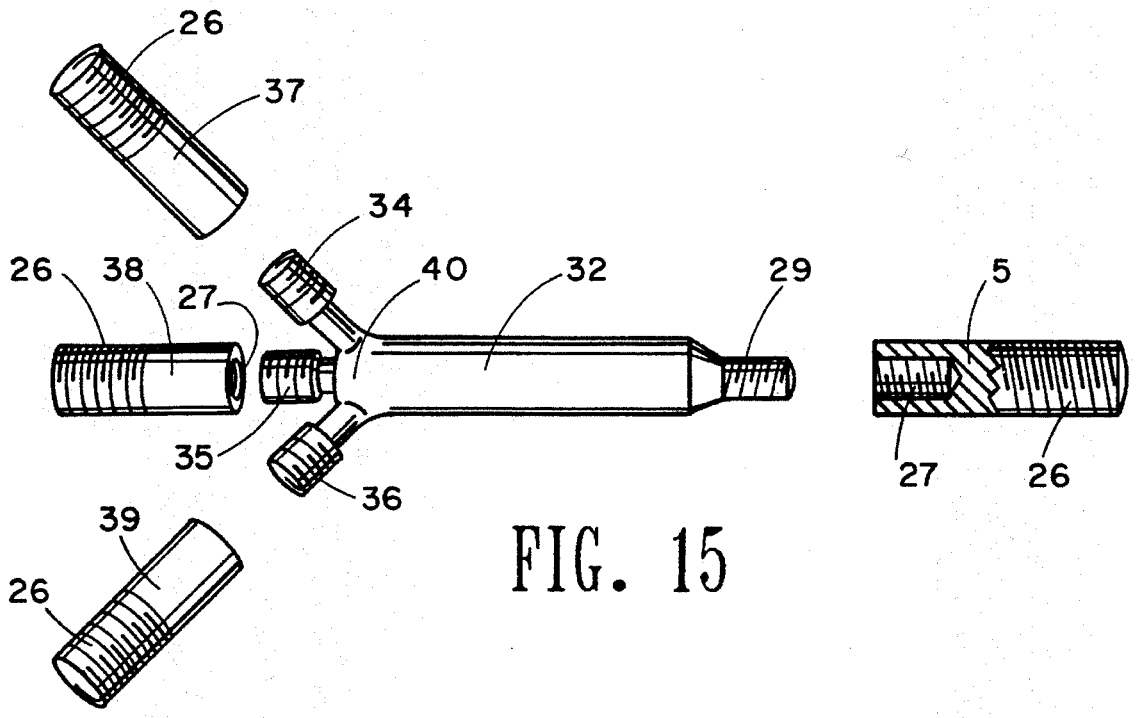
FIG. 15 is a lateral view of a head bolt stud extractor having an inverted tripod shaped handle which provides externally threaded legs for attachment and storage of head bolt studs and having an externally threaded head bolt stud engagement end and of three head bolt studs in position to be attached to the legs of the inverted tripod shaped handle for storage and of a head bolt stud having an internally left-handed threaded end in position for attachment to the externally threaded head bolt stud engagement end of the head bolt stud extractor.

To extract a head bolt stud (3, 4, 5, or 6) from the engine block (1), a head bolt stud extractor (22, 23, 24, or 32) is used. Head bolt stud extractor handles 50, 51, 52, and 40) may be of various useful shapes, each of which has its own advantages. FIGS. 3 and 4 show a head bolt stud extractor (22) having a handle (50) which is of an inverted tripod shape, wherein each of the tripod legs is internally left-hand threaded (41) to screwably receive the externally left-hand threaded (28) end of a head bolt stud (42) of the second embodiment. FIG. 15 shows a head bolt stud extractor (32) having a handle (40) which is of an inverted tripod shape, wherein each of the tripod legs (34, 35, and 36) is externally left-hand threaded to screwably receive the internally left-hand threaded (27) end of a head bolt stud (5, 37, 38, or 39) of the first embodiment. Use of a handle (50 or 40) having an inverted tripod shape wherein each of the tripod legs (34, 35, and 36,or the tripod legs (34, 44, and 45), respectively, is threaded to screwably receive a head bolt stud (42 or 5, respectively) is helpful in storing and maintaining positive control over the location of the head bolt stud (42 or 5, respectively).

Figure 11:
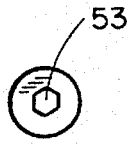
FIG. 11 is a top view of the head bolt stud extractor in FIG. 12.
Figure 12:
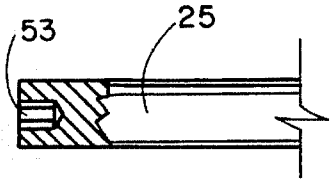
FIG. 12 is a partially cutaway lateral view of a head bolt stud extractor having a standard hexagonal allen wrench insertable aperture as a handle.
Figure 9:
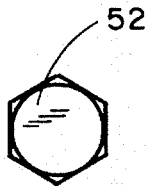
FIG. 9 is a top view of the head bolt stud extractor in FIG. 10.
Figure 10:
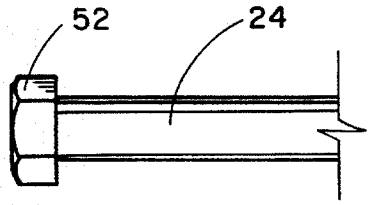
FIG. 10 is a partially cutaway lateral view of a head bolt stud extractor having a standard hexagonal bolt head as a handle.
Figure 6:
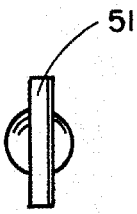
FIG. 6 is a top view of the head bolt stud extractor in FIG. 7.
Figure 7:
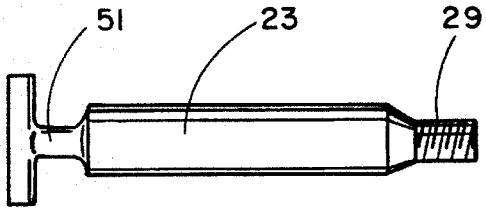
FIG. 7 is a lateral view of a head bolt stud extractor having a horizontal bar handle and an externally threaded head bolt stud engagement end.
Figure 13:
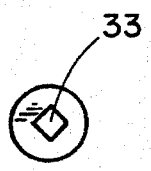
FIG. 13 is a top view of the head bolt stud extractor in FIG. 14.
Figure 14:
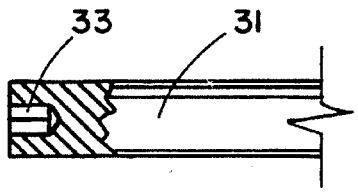
FIG. 14 is a partially cutaway lateral view of a head bolt stud extractor having a standard square ratchet wrench driver insertable aperture as a handle.

FIGS. 6 and 7 show a head bolt stud extractor (23) having a handle (51) which is shaped as a horizontal bar perpendicular to the shaft of the head bolt stud extractor (23). FIGS. 9 and 10 show a head bolt stud extractor (24) having a handle (52) of a standard hexagonal bolt head shape. FIGS. 11 and 12 show a head bolt stud extractor (25) which provides a hexagonally shaped aperture (53) to receive a standard allen wrench. FIGS. 13 and 14 show a head bolt stud extractor (31) which provides a square shaped aperture (33) to receive a standard socket wrench ratchet drive shaft. Each handle 50, 51, 52, and 40) shape has its own advantages, depending upon the operational situation confronted.

Head bolt studs (5 or 42) are normally of such length that when the head bolt stud (5 or 42) is screwably inserted into the engine block (1) and the cylinder head (7) has been seated over the head bolt studs (5 or 42) onto the engine block (1), the head bolt studs (5 or 42) do not extend above the top external surface of the cylinder head (7). Accordingly use of an extension tool, a head bolt stud extractor (22, 23, 24, 25, 31, or 32), is necessary.

Extraction of the head bolt studs (5 or 42) from the engine block (1) depends on the fact that, in both the first and second embodiments, the direction of torque necessary to screwably engage the left-hand threads (30 or 29) of the head bolt stud extractor (22 or 23) with the left-hand threads (28 or 27) of the head bolt stud (42 or 5) is the same direction of torque necessary to screwably disengage the right-hand threads (26) of the head bolt stud (42 or 5) from the engine block (1). In the first embodiment, as seen by reference to FIGS. 1, 2, 7 and 8, screwably engaging the external left-hand threads (29) of the head bolt stud extractor (23) with the internal left-hand threads (27) of the head bolt stud (5) is accomplished with a direction of torque which, once the external left-hand threads (29) of the head bolt stud extractor (23) are fully engaged and seated on the internal left-hand threads (27) of the head bolt stud (5), will act to extract the head bolt stud (5) from the engine block (1) by interaction of the external right-hand threads (26) of the head bolt stud (5) with the internal right-hand threads of the bolt hole (12, 13, 14, 15, 16, 17, 18, 19, 20, or 21) in the engine block (1). In the second embodiment, as seen by reference to FIGS. 1, 4 and 5, screwably engaging the internal left-hand threads (30) of the head bolt stud extractor (22) with the external left-hand threads (28) of the head bolt stud (42) is accomplished with a direction of torque which, once the internal left-hand threads (30) of the head bolt stud extractor (22) are fully engaged and seated on the external left-hand threads (28) of the head bolt stud (42), will act to extract the head bolt stud (42) from the engine block (1) by interaction of the external right-hand threads (26) of the head bolt stud (42) with the internal right-hand threads of the bolt hole (12, 13, 14, 15, 16, 17, 18, 19, 20, or 21) in the engine block (1).

Completion of the installation of the cylinder head (7) onto the engine block (1) following replacement of the seals requires that, after the head bolt studs (3, 4, 5, and 6) are extracted from the engine block (1), the cylinder head bolts be inserted through the bolt holes (8, 9, 10, 11, and six other bolt holes not shown in the drawings) in the cylinder head (7) and screwed into the engine block bolt holes (12, 13, 14, 15, 16, 17, 18, 19, 20, and 21) to secure the cylinder head (7) to the engine block (1).

This invention has been described in terms of certain, above-described, embodiments, however numerous additional embodiments are possible without departing from the essential characteristics thereof. Accordingly, the description has been illustrative and not restrictive as the scope of the invention is defined by the appended claims, not by the description preceding them, and all changes and modifications that fall within the stated claims or form their functional equivalents are intended to be embraced by the claims.

What is claimed is:

1. Head bolt studs useful in the alignment of a cylinder head to an engine block after replacement of the cylinder head seals on said engine block, wherein:

said head bolt studs provide, on one end, external right-hand threads for screwable insertion into said engine block;

said head bolt studs provide, on their end opposite said external right-hand threads, external left-hand threads;

in combination with a head bolt stud extractor which provides, on one end, internal left-hand threads to screwably engage said external left-hand threads of said head bolt studs, and which provides, on its end opposite said internal left-hand threads, a handle or aperture whereby the torque applied to said head bolt stud extractor to screwably engage said external left-hand threads of said head bolt studs acts, once said external left-hand threads and said internal left-hand threads are fully engaged, to screwably extract said head bolt stud from said engine block.

2. The combination of claim 1, further including a handle wherein said handle is shaped as an inverted tripod, each leg of said tripod providing an aperture which provides internal left-hand threads to screwably engage said external left-hand threads of said head bolt stud whereby three of said head bolt studs may be stored on the three legs of said handle.

3. The combination of claim 1 wherein said handle is shaped as a horizontal bar perpendicular to the shaft of said head bolt stud extractor.

4. The combination of claim 1, further including a handle wherein said handle is shaped as a hexagonal bolt head.

5. The combination of claim 1, further including a handle wherein said handle provides an aperture hexagonally shaped to receive an Allen wrench.

6. The combination of claim 1, further including a handle wherein said handle provides an aperture rectangularly shaped to receive a standard ratchet drive.

7. Head bolt studs useful in the alignment of a cylinder head to an engine block after replacement of the cylinder head seals on said engine block, wherein:

said head bolt studs provide, on one end, external right-hand threads for screwable insertion into said engine block;

said head bolt studs provide, on their end opposite their external right-hand threads, internal left-hand threads;

in combination with a head bolt stud extractor which provides, on one end, external left-hand threads to screwably engage said internal left-hand threads of said head bolt studs, and which provides, on its end opposite said external left-hand threads, a handle or aperture whereby the torque applied to said head bolt stud extractor to screwably engage said internal left-hand threads of said head bolt studs acts, once said internal left-hand threads and said external left-hand threads are fully engaged, to screwably extract said head bolt stud from said engine block.

8. The combination of claim 7, further including a handle wherein said handle is shaped as an inverted tripod, each leg of said tripod providing external left-hand threads to screwably engage said internal left-hand threads of said head bolt stud whereby three of said head bolt studs may be stored on the three legs of said handle.

9. The combination of claim 7 wherein said handle is shaped as a horizontal bar perpendicular to the shaft of said head bolt stud extractor.

10. The combination of claim 7, further including a handle wherein said handle is shaped as a hexagonal bolt head.

11. The combination of claim 7, further including a handle wherein said handle provides an aperture hexagonally shaped to receive an Allen wrench.

12. The combination of claim 7, further including a handle wherein said handle provides an aperture rectangularly shaped to receive a standard ratchet drive.

* * * * *